US010584503B2

(12) United States Patent
Fan

(10) Patent No.: US 10,584,503 B2
(45) Date of Patent: Mar. 10, 2020

(54) CONTAINER-TYPE COMBINATION HOUSE AND CONSTRUCTION METHOD THEREOF

(71) Applicants: Taikong Intelligent Construction Co., Ltd., Beijing (CN); Hengyuan Building Plate Industry Company Limited, Tangshan, Hebei Province (CN); Changzhou Green Building Panel Industry Co., Ltd., Changzhou, Jiangsu Province (CN)

(72) Inventor: Li Fan, Beijing (CN)

(73) Assignee: TAIKONG INTELLIGENT CONSTRUCTION CO., LTD., Beijing (CN)

( * ) Notice: Subject to any disclaimer, the term of this patent is extended or adjusted under 35 U.S.C. 154(b) by 0 days.

(21) Appl. No.: 15/993,094

(22) Filed: May 30, 2018

(65) Prior Publication Data

US 2018/0274254 A1 Sep. 27, 2018

Related U.S. Application Data

(63) Continuation-in-part of application No. PCT/CN2016/100719, filed on Sep. 29, 2016.

(30) Foreign Application Priority Data

Dec. 16, 2015 (CN) ..... 2015 1 0940503

(51) Int. Cl.
*E04H 1/12* (2006.01)
*E04H 1/04* (2006.01)
(Continued)

(52) U.S. Cl.
CPC ..... *E04H 1/12* (2013.01); *E04C 2/049* (2013.01); *E04C 2/288* (2013.01); *E04C 2/292* (2013.01);
(Continued)

(58) Field of Classification Search
CPC ... E04H 1/12; E04H 2001/1283; E04H 1/005; E04H 1/04; E04H 1/1205; E04C 2/288;
(Continued)

(56) References Cited

U.S. PATENT DOCUMENTS 4,750,304 A * 6/1988 Bischoff ..... B65D 90/08 52/126.3
4,854,094 A * 8/1989 Clark ..... E04B 1/3483 52/79.1
(Continued)

FOREIGN PATENT DOCUMENTS

CN 1429698 A 7/2003
CN 102041905 A 5/2011
(Continued)

OTHER PUBLICATIONS

English Translation of the Written Opinion for PCT/CN2016/100719 (7 pages). (Year: 2018).*
(Continued)

*Primary Examiner* — Rodney Mintz
(74) *Attorney, Agent, or Firm* — Hauptman Ham, LLP

(57) ABSTRACT

Disclosed is a container type combined house, which is mainly composited by connecting a foam cement composite bottom board, foam cement composite wall boards, a foam cement composite top board, specially-shaped bottom beams, a specially-shaped top beam and a specially-shaped column. The specially-shaped bottom beams, the specially-shaped top beam and the specially-shaped column are matched in shape with steel boundary ribs of the foam cement composite bottom board, the foam cement composite wall boards and the foam cement composite top board, and are connected and fixed in a mechanical or welding manner. According to the construction method of the con-
(Continued)

tainer type combined house, the combined house is easily assembled, with good comprehensive performance.

20 Claims, 13 Drawing Sheets

(51) Int. Cl.

| | |
|---|---|
| ***E04H 1/00*** | (2006.01) |
| ***E04C 2/04*** | (2006.01) |
| ***E04C 2/292*** | (2006.01) |
| ***E04C 2/288*** | (2006.01) |
| ***E04C 2/38*** | (2006.01) |
| ***E04C 2/52*** | (2006.01) |

(52) U.S. Cl.
CPC ..... *E04C 2/384* (2013.01); *E04C 2/521* (2013.01); *E04H 1/005* (2013.01); *E04H 1/04* (2013.01); *E04H 1/1205* (2013.01); *E04H 2001/1283* (2013.01)

(58) Field of Classification Search
CPC ..... E04C 2/384; E04C 2/521; E04C 2/049; E04C 2/292; E04C 2/52
See application file for complete search history.

(56) References Cited

U.S. PATENT DOCUMENTS 4,910,932 A * 3/1990 Honigman ..... E04B 1/08 52/280
5,348,778 A * 9/1994 Knipp ..... B32B 3/06 312/400
8,677,698 B2 * 3/2014 Segall ..... E04B 1/34315 52/127.9
9,016,002 B2 * 4/2015 Segall ..... G09B 9/003 52/79.5
9,109,356 B2 * 8/2015 Segall ..... E04B 1/34315
9,663,937 B2 * 5/2017 Goldman ..... E04B 1/3483
9,920,513 B2 * 3/2018 Segall ..... E04B 1/34315
10,119,271 B2 * 11/2018 Franck ..... E04B 2/68
10,480,203 B2 * 11/2019 Park ..... E04F 13/12
2009/0019811 A1 1/2009 Goldman
2009/0223161 A1 * 9/2009 Segall ..... E04B 1/34315 52/588.1
2009/0307994 A1 * 12/2009 Cathcart ..... E04B 1/3483 52/79.9
2011/0289860 A1 * 12/2011 Wilson ..... E04B 1/34315 52/79.5
2011/0297675 A1 * 12/2011 Johnson ..... B60P 3/14 220/8
2014/0123572 A1 * 5/2014 Segall ..... G09B 9/003 52/79.5
2014/0141160 A1 * 5/2014 Strachan ..... B28B 1/29 427/209
2014/0202114 A1 * 7/2014 Segall ..... E04B 1/34315 52/745.1
2015/0135634 A1 * 5/2015 Hoie ..... E04C 2/205 52/741.4
2015/0354199 A1 * 12/2015 Segall ..... E04B 1/34315 52/127.6
2016/0222644 A1 * 8/2016 Rossi ..... E04B 1/34321
2017/0044764 A1 * 2/2017 Franck ..... E04B 2/68
2017/0130475 A1 * 5/2017 Park ..... E04B 9/001
2019/0352897 A1 * 11/2019 Takemoto ..... E04C 2/20

FOREIGN PATENT DOCUMENTS

CN 204590249 U 8/2015
CN 105464409 A 4/2016
CN 205189444 U 4/2016
JP 2013-185375 A 9/2013

OTHER PUBLICATIONS

PCT/ISA/210, "International Search Report for International Application No. PCT/CN2016/100719," dated Jan. 5, 2017.
Chinese Patent Application No. 201510940503.1; First Office Action dated Mar. 17, 2017.
Chinese Patent Application No. 201510940503.1; Second Office Action dated Jan. 4, 2018.

* cited by examiner

CONTAINER-TYPE COMBINATION HOUSE AND CONSTRUCTION METHOD THEREOF

TECHNICAL FIELD

The present disclosure relates to the field of buildings and more particularly to a container-type combined house and a construction method thereof.

BACKGROUND

At present, a conventional container-type house used in the building field is widely used as a temporary office or residence at a construction site, a field workplace and so on. An existing container-type house is generally constructed by transforming an old container or by assembling sandwiched color steel plates. The main body of the container-type house is made of steel. Since steel is inherently extremely high in thermal conductivity, the container-type house may have poor heat preservation and insulation performance, and poor sound insulation performance and also may consume a great amount of energy. There is also a wood-made container-type house and the house may have defects of no fire resistance, poor heat preservation and insulation performance and poor sound insulation performance.

SUMMARY

The present disclosure is intended to overcome defects of the prior art by providing a container-type combined house which is constructed simply and quickly with prefabricated foam cement composite boards on a mass production scale and a construction method thereof. According to the present disclosure, basic facilities such as water supply pipe fittings, water drainage pipe fittings, electric devices and doors and windows may be prefabricated or pre-installed in a foam cement composite board, and waterproofing and internal and external decorations may be completed in a factory. The container-type combined house disclosed in the present disclosure is an energy-saving, environment-friendly and green building featuring light weight, a weight bearing, heat preservation, heat insulation, durability, earthquake resistance, fireproofing, waterproofing and sound insulation.

A technical solution of the present disclosure is as follows.

A container-type combined house is mainly constructed by combining, and fixedly connecting a foam cement composite bottom board, a foam cement composite wall board, a foam cement composite top board, a specially-shaped bottom beam, a specially-shaped top beam and a specially-shaped column, where the specially-shaped bottom beam, the specially-shaped top beam or the specially-shaped column is arranged to be matched in shape with a steel boundary rib of the foam cement composite bottom board, the foam cement composite wall board or the foam cement composite top board respectively and then accurately, rapidly and fixedly connected in a mechanical or welding manner so as to construct a single container-type combined house.

The foam cement composite bottom board is composited with a steel frame, a reinforcement truss, a steel wire mesh, an inorganic foam cement core material and upper and lower cement mortar surface layers, where the steel wire mesh is fixedly connected to the steel frame, and the foam cement composite bottom board includes water drainage pipe fittings having a drain pipe, a floor drain.

The foam cement composite wall board is composited with a steel frame, a steel wire mesh, a reinforcement truss, an inorganic foam cement core material and upper and lower cement mortar surface layers, where the steel wire mesh is fixedly connected to the steel frame; a water supply pipe, a water supply connector, a concealed switch box and a wire pipe may be arranged in the foam cement composite wall board, and also a door hole and a window hole may be provided in the composite wall board.

The foam cement composite top board is composited with a steel frame, a steel wire mesh, a reinforcement truss, an inorganic foam cement core material and upper and lower cement mortar surface layers, where the steel wire mesh is fixedly connected to the steel frame; the foam cement composite top board includes a concealed light holder box, a pipeline, a ventilation hole and a hole for inspection and repair.

An internal surface and an external surface of the container-type combined house may be decorated with different ornaments and decoration materials so as to meet decoration requirements for different styles of bathrooms.

A construction method of a container-type combined house may include the following steps:

Step A: performing industrialized custom production of a foam cement composite bottom board, a foam cement composite wall board and a foam cement composite top board according to an actual requirement of a customer, and prefabricating water supply pipe fittings, water drainage pipe fittings, electric devices and a door hole and a window hole in the foam cement composite boards according to a design requirement;

Step B: fixedly connecting the specially-shaped bottom beam to a corresponding bottom board steel boundary rib of the foam cement composite bottom board and a corresponding wall board steel boundary rib of the foam cement composite wall board in the mechanical manner or welding manner;

Step C: fixedly connecting the specially-shaped column to a corresponding wall board steel boundary rib of the foam cement composite wall board and a corresponding wall board steel boundary rib of a further foam cement composite wall board in a mechanical manner or welding manner; and Step D: fixedly connecting the specially-shaped top beam to a corresponding wall board steel boundary rib of the foam cement composite wall board and a corresponding top board steel boundary rib of the foam cement composite top board in a mechanical manner or welding manner;

Waterproofing and internal and external decorations for the container-type combined house may be completed in a factory as required.

The foam cement composite board includes a reinforcing rib structure according to the number of the floors to be built and different requirements for strength so as to improve an overall force-bearing strength.

The container-type combined house integrates both weight bearing and heat preservation and also a thickness of the foam cement board may be configured to be changed or a polyurethane material with a smaller heat conductivity coefficient is included in the foam cement board according to temperatures in different regions.

BRIEF DESCRIPTION OF DRAWINGS

FIG. 2-1 and FIG. 2-4 are schematic diagrams illustrating a structure of a foam cement composite bottom board according to an example 1 of the present disclosure.

FIG. 2-2 and FIG. 2-5 are schematic diagrams illustrating a structure of a foam cement composite wall board according to an example 1 of the present disclosure.

FIG. 2-3 and FIG. 2-6 are schematic diagrams illustrating a structure of a foam cement composite top board according to an example 1 of the present disclosure.

FIG. 3-1, FIG. 3-2 and FIG. 3-3 are schematic diagrams illustrating a section of a specially-shaped beam according to an example 1 of the present disclosure.

FIG. 4 is a schematic diagram illustrating a section of a specially-shaped column according to an example 1 of the present disclosure.

FIG. 5-1 and FIG. 5-2 are schematic diagrams illustrating a structure of a connecting node of a foam cement composite wall board and a foam cement composite bottom board according to an example 1 of the present disclosure.

FIG. 6 is a schematic diagram illustrating a structure of a connecting node of different foam cement composite wall boards according to an example 1 of the present disclosure.

FIG. 8-1 to FIG. 8-3 are schematic assembly diagrams illustrating a three-dimensional structure of a container-type 2-floor combined house according to an example 2 of the present disclosure.

FIG. 9-1 and FIG. 10-1 are schematic diagrams illustrating a structure of a foam cement composite bottom board or a foam cement composite floor board according to an example 2 of the present disclosure.

FIG. 9-2 and FIG. 10-2 are schematic diagrams illustrating a structure of a foam cement composite wall board according to an example 2 of the present disclosure.

FIG. 9-3 and FIG. 10-3 are schematic diagrams illustrating a structure of a foam cement composite top board or a foam cement composite roof board according to an example 2 of the present disclosure.

FIG. 11-1 is a schematic diagram illustrating a steel base according to an example 2 of the present disclosure.

FIG. 11-2 is a schematic diagram illustrating a connecting part according to an example 2 of the present disclosure.

FIG. 11-3 is a schematic diagram illustrating a steel column according to an example 2 of the present disclosure.

FIG. 11-4 is a schematic diagram illustrating a seal cap according to an example 2 of the present disclosure.

FIG. 12-1 and FIG. 12-2 are schematic diagrams illustrating a structure of a connecting node of a foam cement composite wall board and a foam cement composite top board according to an example 2 of the present disclosure.

FIG. 12-3 and FIG. 12-4 are schematic diagrams illustrating a structure of a connecting node of a foam cement composite wall board, a foam cement composite bottom board and a foam cement composite floor board according to an example 2 of the present disclosure.

FIG. 12-5 and FIG. 12-6 are schematic diagrams illustrating a structure of a connecting node of a container-type multi-floor house according to an example 2 of the present disclosure.

DESCRIPTIONS OF REFERENCE NUMERALS IN ACCOMPANYING DRAWINGS

Figure 1:
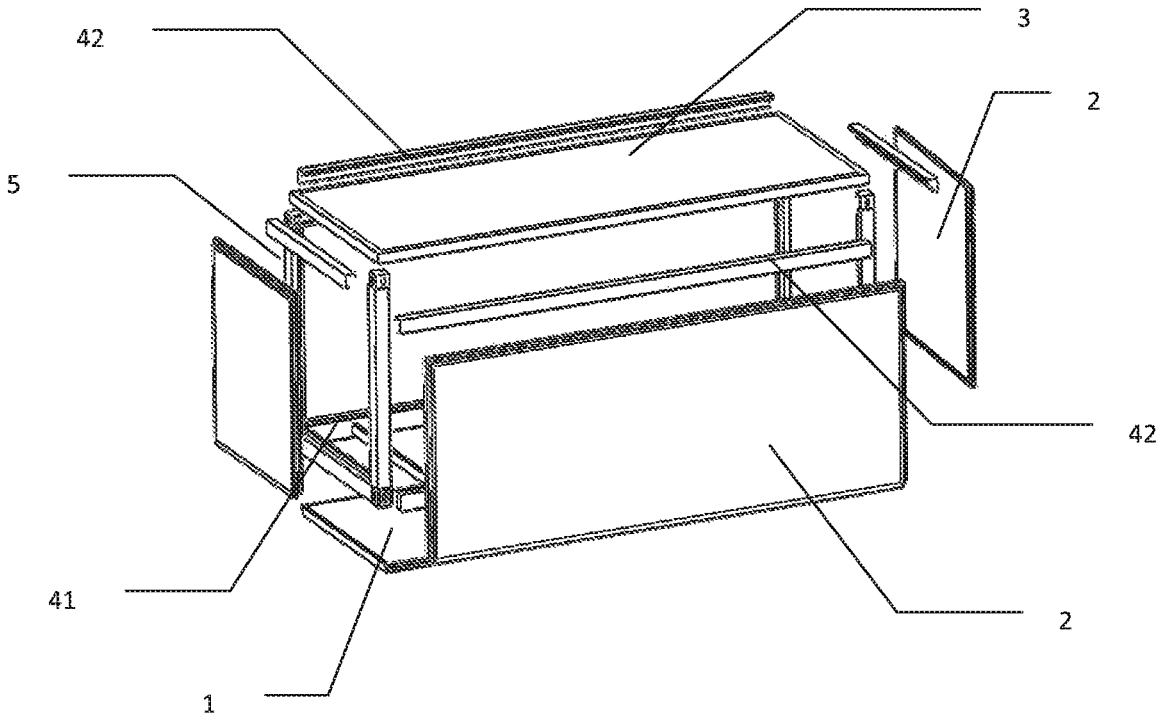
FIG. 1 is a schematic diagram illustrating a three-dimensional structure of a container-type combined house according to an example 1 of the present disclosure.

1: a foam cement composite bottom board;
11: a foam cement composite floor board;
2: a foam cement composite wall board;
3: a foam cement composite top board;
41 and 41': specially-shaped bottom beams;
42: a specially-shaped top beam;
5: a specially-shaped column
101: a steel frame;
102: a reinforcement truss;
103: an inorganic foam cement core material;
104: upper and lower cement mortar surface layers;
105: a steel wire mesh;
106: a bottom board steel boundary rib;
107: a floor board steel boundary rib;
206 and 207: wall board steel boundary ribs;
306 and 307: top board steel boundary ribs;
6: steel base;
71: hole;
72: hole;
73: hole;
74: hole;
75: through hole;
8: connecting part
9: steel column;
10: seal cap;
A and B: container-type houses

DETAILED DESCRIPTION

Example 1

As shown in FIG. 1-FIG. 7, a container-type combined house provided according to an example 1 of the present disclosure is mainly constructed by combining, and fixedly connecting a foam cement composite bottom board 1, foam cement composite wall boards 2, a foam cement composite top board 3, a specially-shaped bottom beam 41, a specially-shaped top beam 42 and a specially-shaped column 5, where the specially-shaped bottom beam 41, the specially-shaped top beam 42 or the specially-shaped column 5 is matched in shape with a bottom board steel boundary rib 106, a wall board steel boundary rib 206, or a top board steel boundary rib 306 respectively and then accurately, rapidly and fixedly connected in a mechanical or welding manner.

The foam cement composite bottom board 1 is composited with a steel frame 101, a reinforcement truss 102, an inorganic foam cement core material 103, a steel wire mesh 105 and upper and lower cement mortar surface layers 104, where the steel wire mesh 105 is fixedly connected to the steel frame 101, and the foam cement composite bottom board 1 includes drainage pipe fittings having a drain pipe, and a floor drain (not marked in FIG).

The foam cement composite wall board 2 is composited with the steel frame 101, the reinforcement truss 102, the inorganic foam cement core material 103, the steel wire mesh 105 and the upper and lower cement mortar surface layers 104, where the steel wire mesh 105 is fixed connected to the steel frame 101 and a water supply pipe, a water supply connector, a concealed switch box and a wire pipe may be arranged in the foam cement composite wall board 2, and also the composite wall board includes a door hole, a window hole and so on (not marked in Fig.).

The foam cement composite top board 3 is composited with the steel frame 101, the reinforcement truss 102, the inorganic foam cement core material 103, the steel wire mesh 105 and the upper and lower cement mortar surface layers 104, where the steel wire mesh 105 is fixedly connected to the steel frame 101, and the foam cement composite top board 3 includes a concealed light holder box, a pipeline, a ventilation hole, and a hole for inspection and repair and so on (not marked in FIG).

Figures 1, 2:
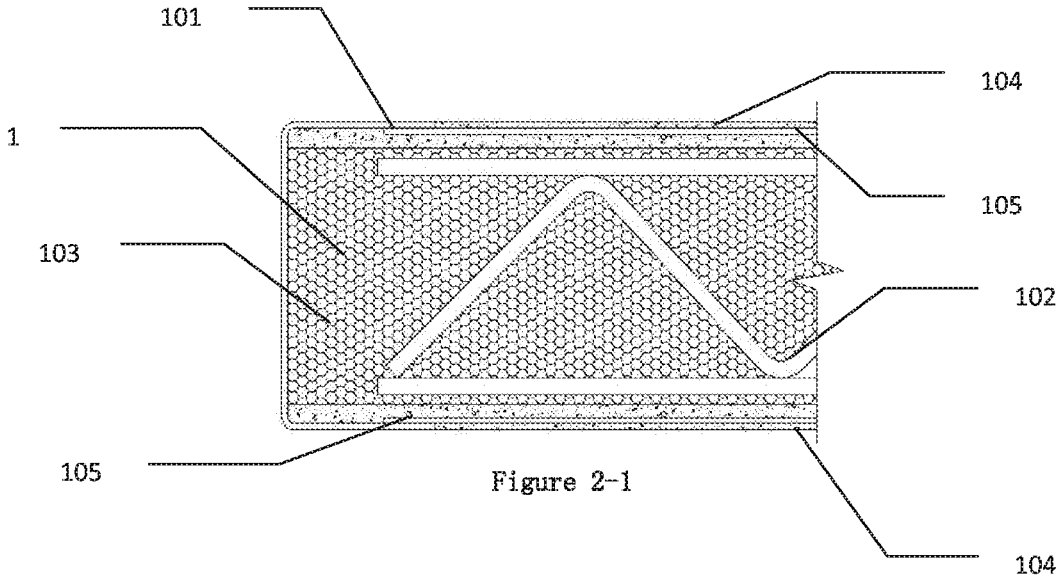
Figure 2:
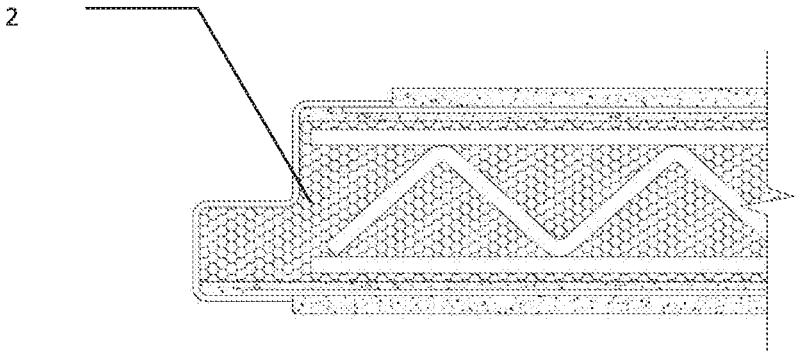
Figures 2, 3:
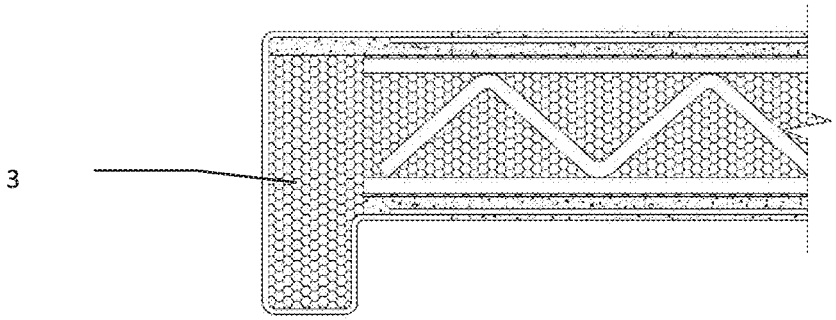
Figures 2, 3, 4:
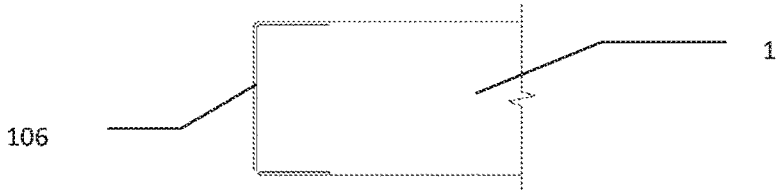
Figures 2, 3, 4, 5:
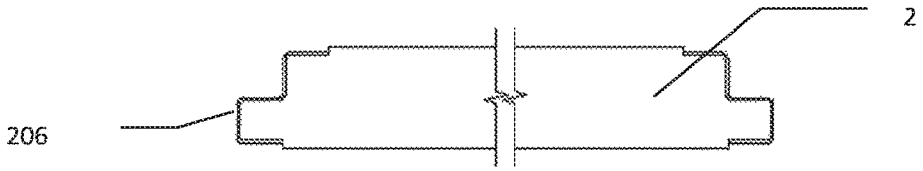

As shown in FIG. 5-1, the specially-shaped bottom beam 41 (short side) described in the present disclosure is fixedly connected to the corresponding bottom board steel boundary rib 106 in the foam cement composite bottom board 1 and the corresponding wall board steel boundary rib 206 in the foam cement composite wall board 2 in a welding manner.

As shown in FIG. 5-2, the specially-shaped bottom beam 41' (long side) described in the present disclosure is arranged to be fixedly connected with the corresponding bottom board steel boundary rib 106 in the foam cement composite bottom board 1 and the corresponding wall board steel boundary rib 206 in the foam cement composite wall board 2 respectively, and then fixedly connected in a welding manner.

When rainwater flows into a house from the outside of a wall, the rainwater may first flow inwardly along a gap on the specially-shaped bottom beam 41 or 41'. Due to a protrusion structure of the specially-shaped bottom beam, the rainwater cannot flow up a boss surface under action of gravitational force when running to a vertical side of a different height, thus preventing the rainwater from seeping into the house. Thus, due to the connection of the foam cement composite bottom board 1 and the foam cement composite wall board 2, the rainwater is prevented from flowing into the house, therefore achieving a waterproofing effect.

Figures 2, 3, 4, 5, 6:
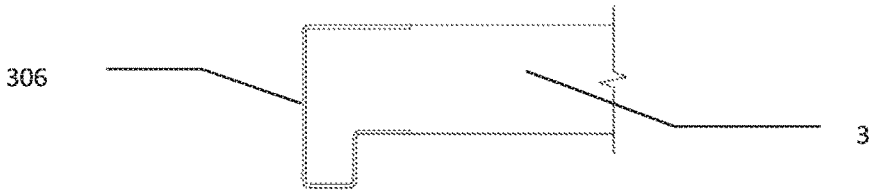
Figures 1, 2, 3:
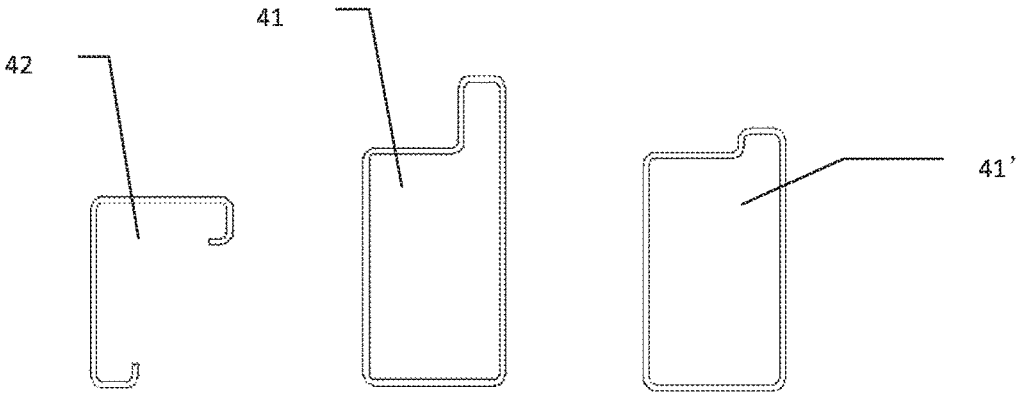
Figure 4:
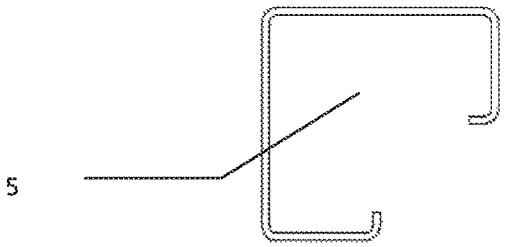
Figures 1, 5:
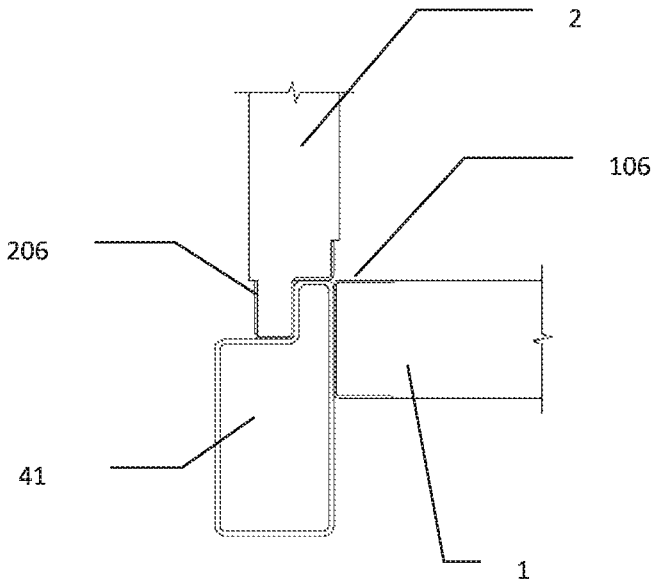
Figures 2, 5:
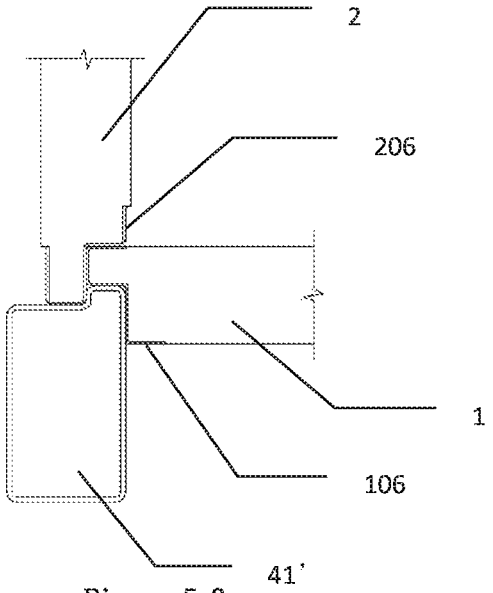
Figure 6:
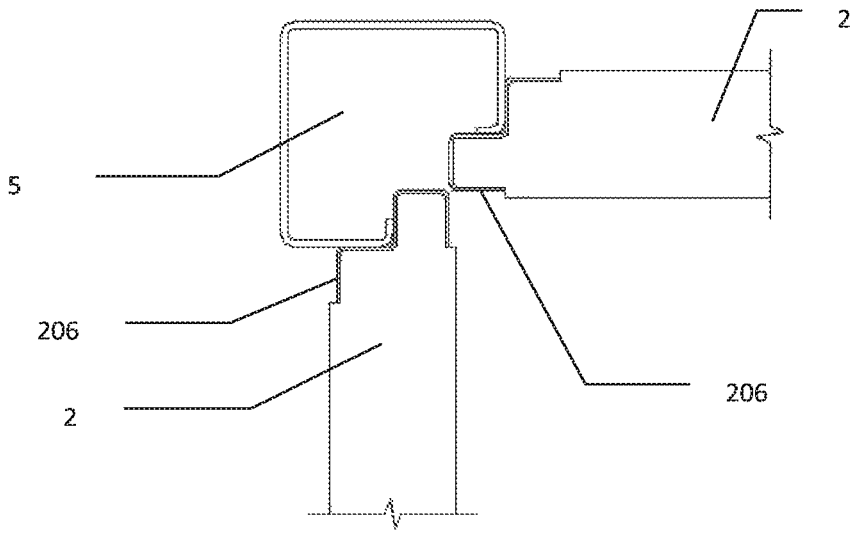

As shown in FIG. 6, the specially-shaped column 5 described in the present disclosure is arranged to be fixed connected with the corresponding wall board steel boundary rib 206 in one foam cement composite wall board 2 and the corresponding wall board steel boundary rib 206 in another foam cement composite wall board 2, and then fixedly connected in a welding manner.

Water seepage in a vertical gap between external wall boards mainly results from liquid capillarity, that is, the rainwater may flow horizontally or even vertically along the direction of the tiny gap between the wall boards under a combined effect of liquid wetting angle and liquid surface tension when entering the gap between the wall boards. Due to effective cooperation between the specially-shaped column 5 and the foam cement composite wall board, the rainwater can only flow towards the ground along a hollow chamber under the effect of gravity in the absence of a capillarity action. Therefore, a waterproofing effect can also be achieved by the connection between the specially-shaped column 5 and the foam cement composite wall board.

Figure 7:
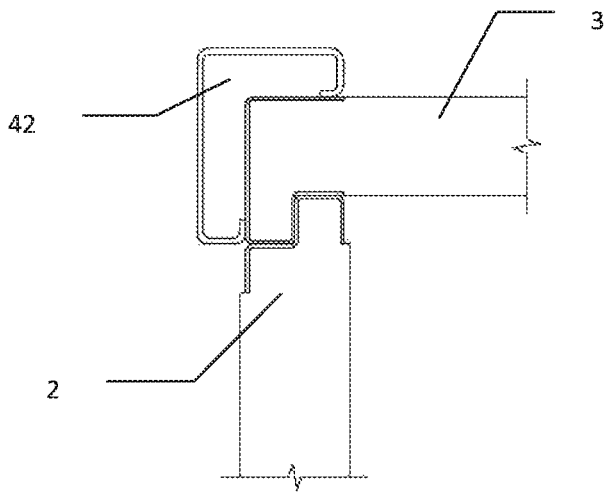
FIG. 7 is a schematic diagram illustrating a structure of a connecting node of a foam cement composite wall board and a foam cement composite top board according to an example 1 of the present disclosure.
Figures 1, 8:
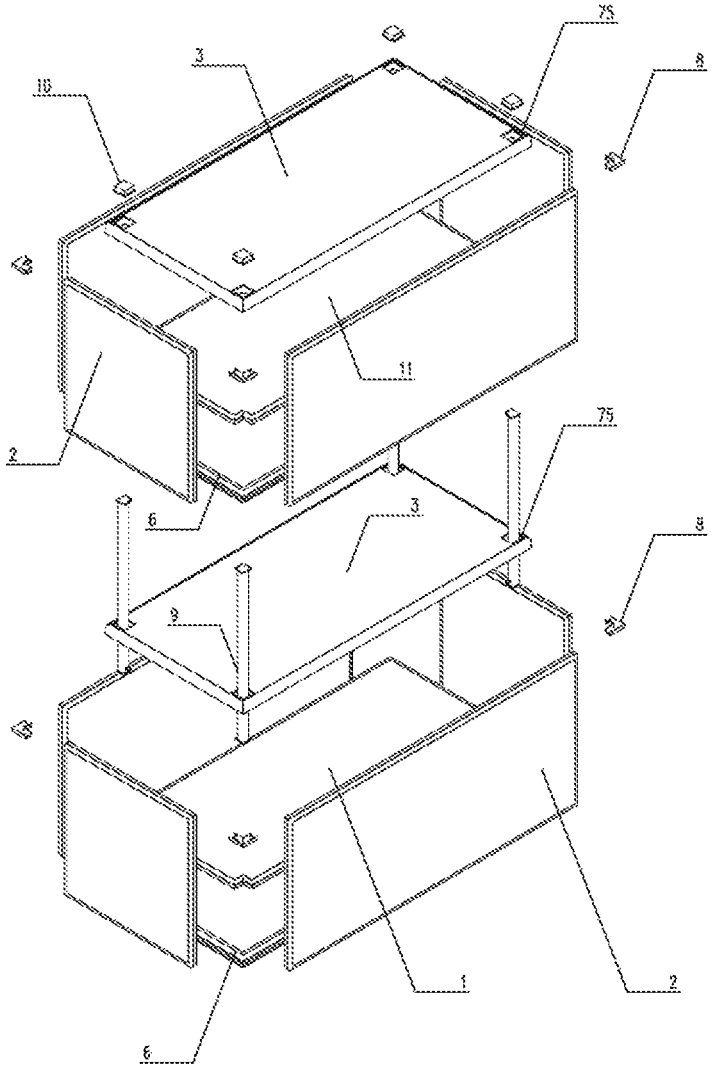
Figures 2, 8:
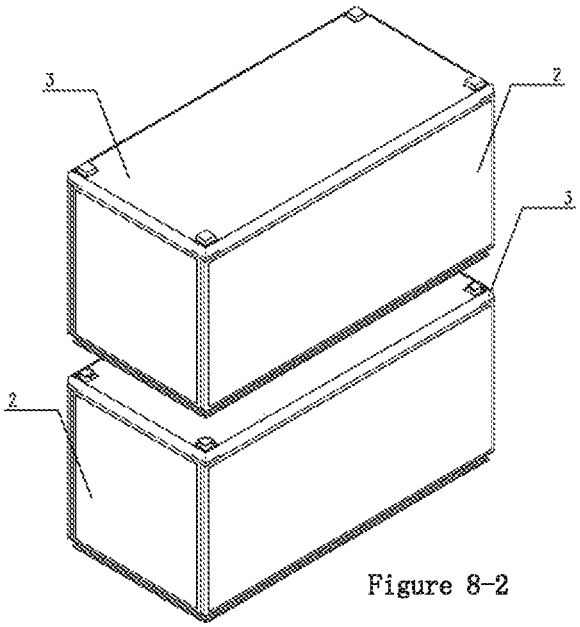
Figures 3, 8:
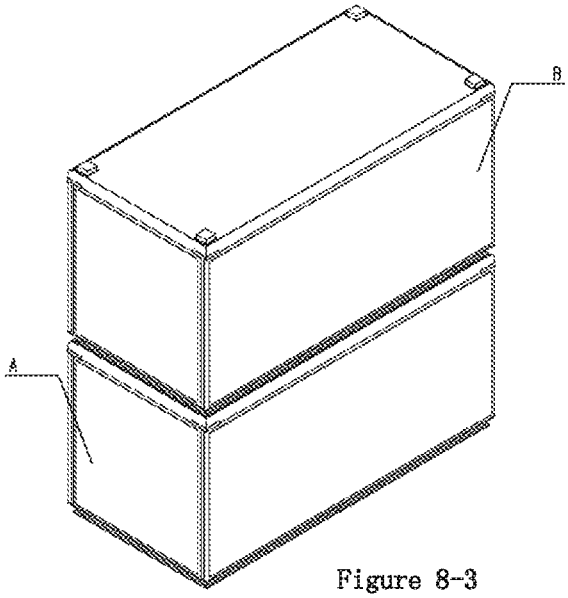
Figures 1, 9:
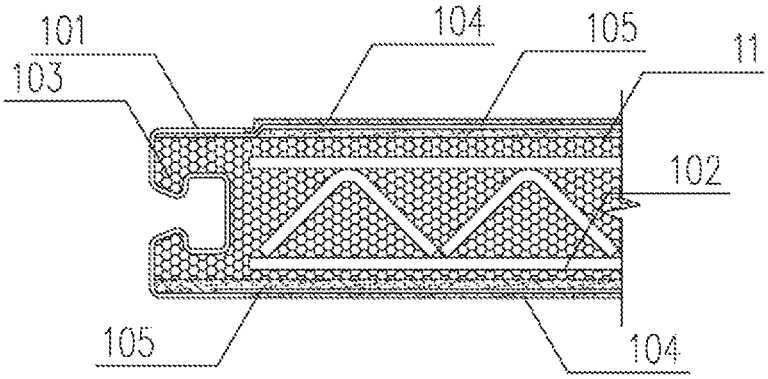
Figures 2, 9:
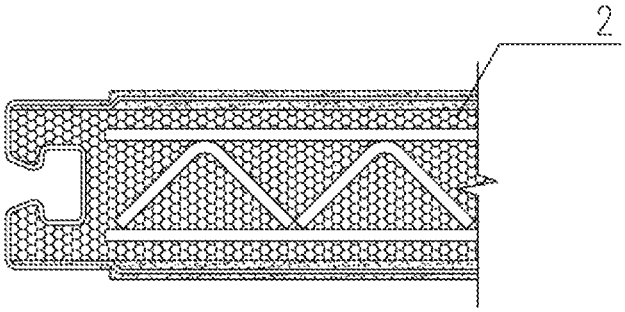
Figures 3, 9:
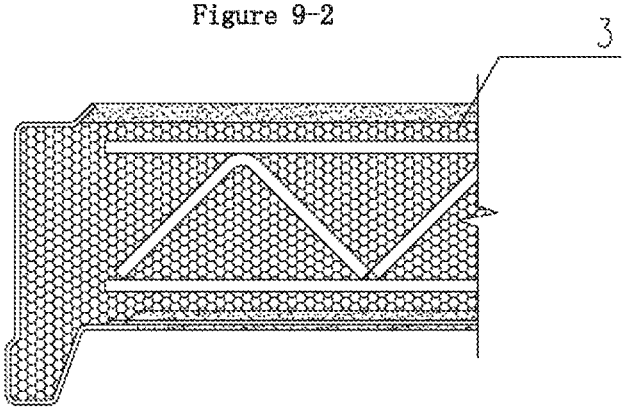
Figures 1, 10:
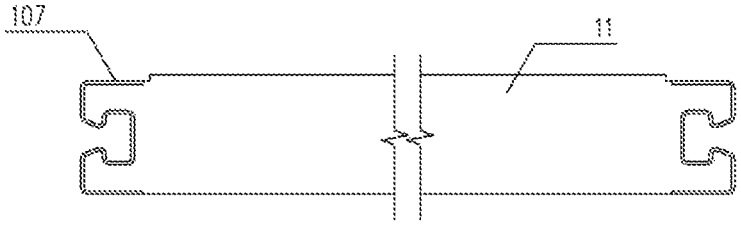
Figures 2, 10:
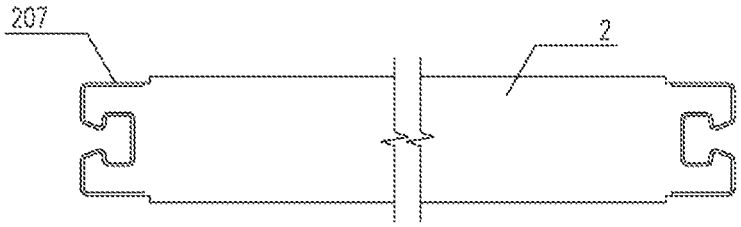
Figures 3, 10:
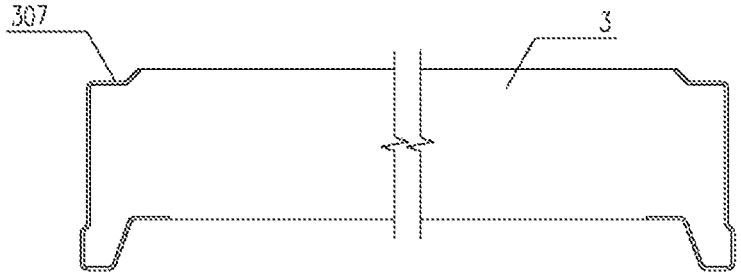
Figures 1, 11:
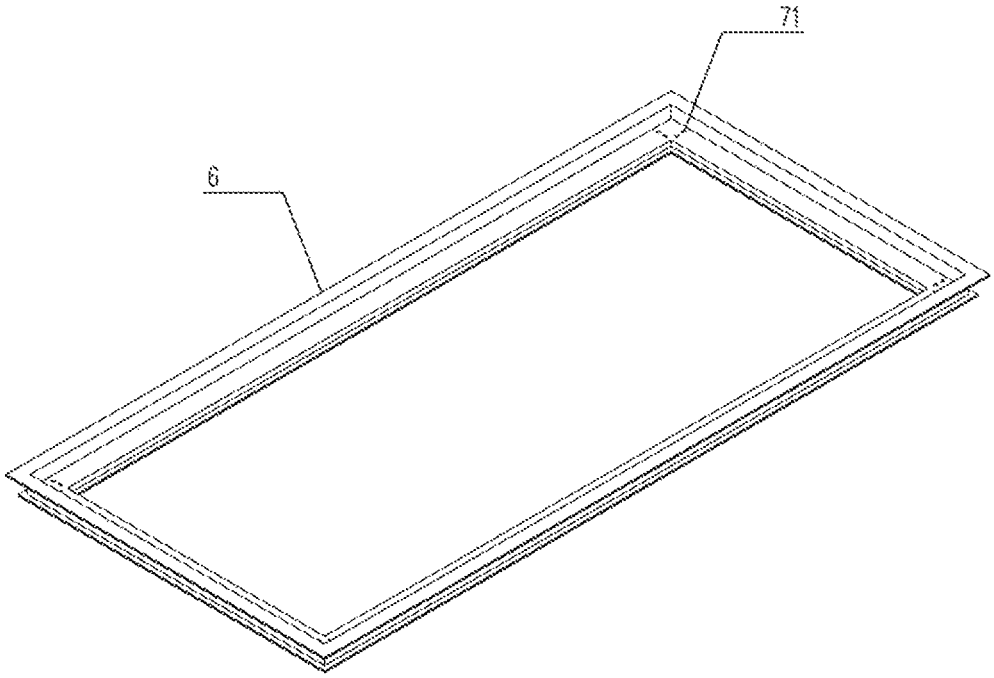
Figures 2, 11:
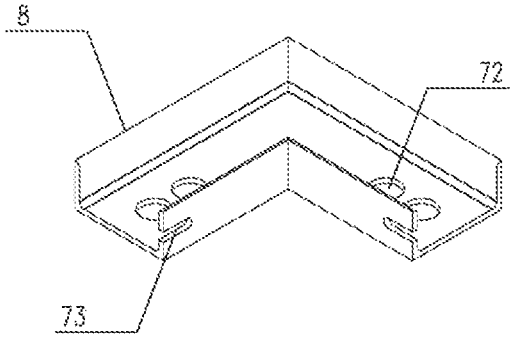
Figures 3, 11:
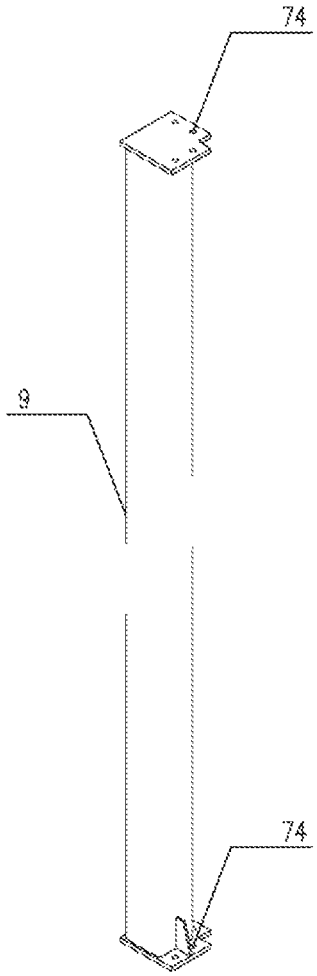
Figures 4, 11:
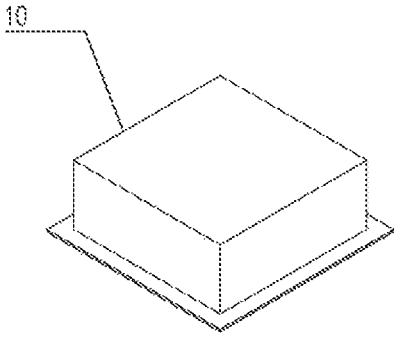

As shown in FIG. 7, the specially-shaped top beam 42 described in the present disclosure is arranged to be fixedly connected with the corresponding wall board steel boundary rib 206 in the foam cement composite wall board 2 and the corresponding top board steel boundary rib 306 in the foam cement composite top board 3, and then fixedly connected in a welding manner.

Example 2

As shown in FIG. 8-FIG. 12, a container-type multi-floor combined house is illustrated according to an example 2 of the present disclosure. The house mainly includes a foam cement composite bottom board 1, a foam cement composite floor board 11, foam cement composite wall boards 2 and a foam cement composite top board 3, where the foam cement composite bottom board 1 and the foam cement composite floor board 11 are arranged on a steel base 6 respectively; each of the foam cement composite bottom board 1 and the foam cement composite floor board 11 has four corners provided with four cutouts, respectively for fixing steel columns 9; the bottom of the foam cement composite wall board 2 is fixed to the steel base 6; a connecting part 8 is used to fixedly connect the foam cement composite wall board 2 and the foam cement composite top board 3 that are adjacent to each other; the foam cement composite top board 3 is provided with four through holes 75; the steel columns 9 are arranged on the four corners of the steel base 6 by extending through the through holes 75 in the foam cement composite top board; a seal cap 10 is provided at the steel column 9 that extends through each of the four corners of the foam cement composite top board 3 so as to achieve waterproofing effect.

The steel base 6, the connecting part 8 and the steel column 9 are matched in shape with a floor board steel boundary rib 107 or a wall board steel boundary rib 207 and a top board steel boundary rib 307 respectively and then accurately, rapidly and fixedly connected in a mechanical or welding manner.

The foam cement composite bottom board 1 or the foam cement composite floor board 11 is composited with a steel frame 101, a reinforcement truss 102, an inorganic foam cement core material 103, a steel wire mesh 105 and upper and lower cement mortar surface layers 104, where the steel wire mesh 105 is fixedly connected to the steel frame 101, the four cutouts are located on the four corners of the foam cement composite bottom board 1 and the cutouts are in the form of square and also the foam cement composite bottom board 1 includes water drainage pipe fittings having a drain pipe, and a floor drain (not marked in FIG).

The foam cement composite floor board 11 is composited with the steel frame 101, the reinforcement truss 102, the inorganic foam cement core material 103, the steel wire mesh 105 and the upper and lower cement mortar surface layers 104, where the steel wire mesh 105 is fixedly connected to the steel frame 101; the four cutouts are provided on the four corners of the foam cement composite floor board 11 and the cutouts are in the form of square and also the foam cement composite bottom board 1 includes water drainage pipe fittings having a drain pipe, and a floor drain (not marked in FIG).

The foam cement composite wall board 2 is composited with the steel frame 101, the reinforcement truss 102, the inorganic foam cement core material 103, the steel wire mesh 105 and the upper and lower cement mortar surface layers 104, where the steel wire mesh 105 is fixedly connected to the steel frame 101; a water supply pipe, a water supply connector, a concealed switch box and a wire pipe may be arranged in the foam cement composite wall board 2, and also a door hole, a window hole and so on (not marked in FIG) may be provided in the composite wall board 2.

The foam cement composite top board 3 is composited with the steel frame 101, the reinforcement truss 102, the inorganic foam cement core material 103, the steel wire mesh 105 and the upper and lower cement mortar surface layers 104, where the steel wire mesh 105 is fixedly connected to the steel frame 101; four corners of the foam cement composite top board 3 are respectively provided with a through hole 75 having a square structure; the foam cement composite top board 3 includes a concealed light holder box, a pipeline, a ventilation hole, a hole for inspection and repair and so on (not marked in FIG).

Figures 1, 12:
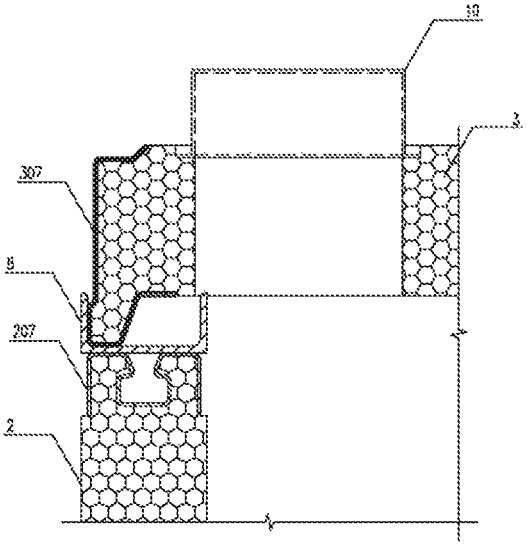
Figures 2, 12:
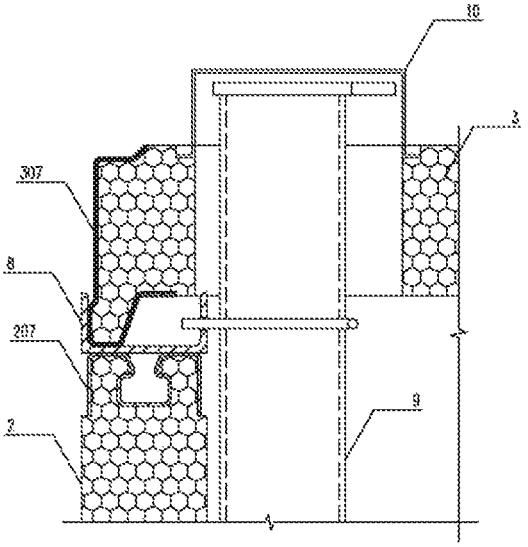
Figures 3, 12:
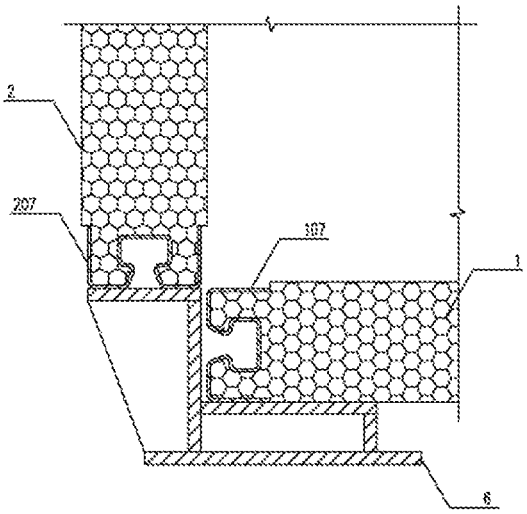
Figures 4, 12:
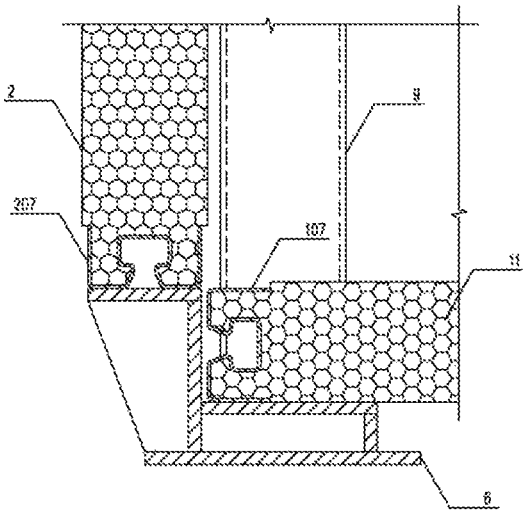
Figures 5, 12:
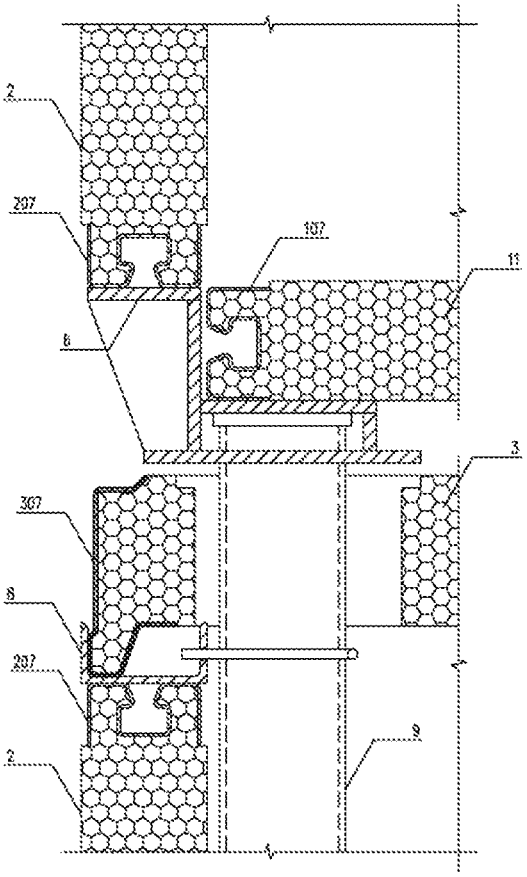
Figures 6, 12:
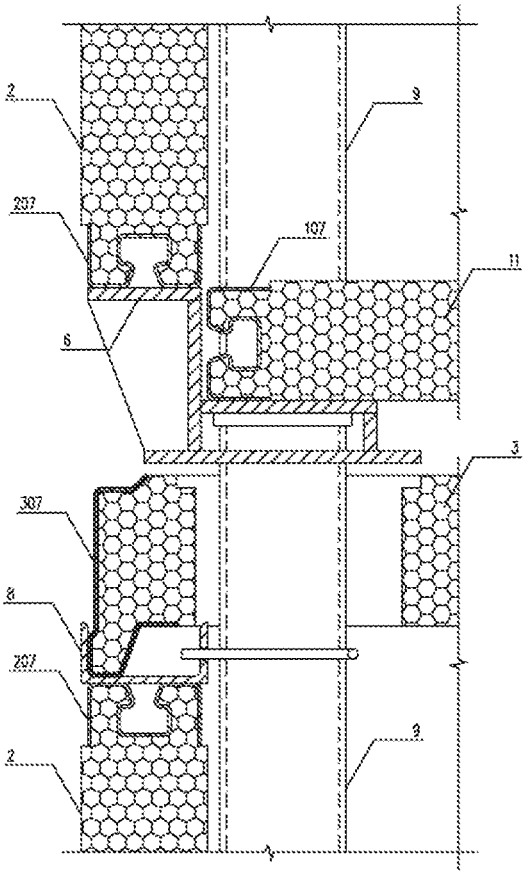

As shown in FIG. 12-3 and FIG. 12-4, the steel base 6 is arranged to be fixedly connected with the corresponding foam cement composite bottom board 1, a corresponding floor board steel boundary rib 107 in the foam cement composite floor board 11 and a corresponding wall board steel boundary rib 207 in the foam cement composite wall board 2 respectively, and also be fixedly connected with the corresponding steel column 9 in a mechanical or welding manner.

As shown in FIG. 12-1 and FIG. 12-2, the wall board steel boundary rib 207 in one foam cement composite wall board 2 is connected with the wall board steel boundary rib 207 in adjacent foam cement composite wall board 2 through a connecting part 8, and the steel column 9 is fixedly connected with a corresponding connecting part 8 in a mechanical or welding manner; and the seal cap 10 is fixedly connected with the hole of the foam cement composite top board 3 as a hole seal in a mechanical manner.

When rainwater flows into a roof, the fixed connection of the foam cement composite top board 3 with the foam cement composite wall board 2 can guarantee that the rainwater will flow into a hollow chamber in the steel frame 207 of the foam cement composite wall board 2 when flowing along a gap and then flow towards the ground along the hollow chamber, thus effectively achieving a waterproofing effect.

Water seepage in a vertical gap between external wall boards mainly results from liquid capillarity, that is, the rainwater may flow horizontally or even vertically along the direction of the tiny gap between the wall boards under a combined effect of liquid wetting angle and liquid surface tension when entering the gap between the wall boards. Due to effective cooperation between the foam cement composite wall boards, the rainwater can only flow towards the ground along the hollow chamber under the effect of gravity in the absence of a capillarity action, thereby achieving a waterproofing effect.

As shown in FIG. 12-5 and FIG. 12-6, according to the present disclosure, the steel base 6 is arranged to be fixedly connected with the steel column 9 in a mechanical or welding manner so that a force is mainly concentrated on the steel base 6 and the steel column 9; thus, the connection between the steel base 6 and the steel column 9 can effectively guarantee a rational force is borne and the container-type house becomes safer, more stable and more reliable; it is realized that a container-type house can be combined into a townhouse or a multi-floor house, thereby effectively utilizing a space resource.

A seal board (not marked in FIG) is provided between two floors of a container-type house A and B and fixed on the wall board steel boundary ribs 207 in the foam cement composite wall boards 2 of an upper floor and a lower floor and treated with waterproofing construction process to achieve a waterproofing effect.

During the assembly of a complete container-type house, different parts need to be mechanically connected with each other and a welding manner is only used for reinforcing the connection. Thus, it is simpler and more convenient to assemble and disassemble a complete container-type house due to the adoption of a more economical assembly mode.

According to an example of the present disclosure, an internal surface and an external surface of the container-type combined house may be decorated with different ornaments and decoration materials so as to meet the decoration requirements for different styles of bathrooms.

A steel stairway may be pre-installed inside or outside the whole multi-floor container-type house to meet the needs for use of upper and lower floors.

Those skilled in the art may combine different foam cement composite boards freely based on different design requirements in an example of the present disclosure. The foregoing examples are merely preferred examples of the present disclosure but not intended to limit the present disclosure, and any modifications, equivalent substitutions, improvements thereof made within the spirit and principles of the present disclosure shall be encompassed in the scope of protection of the present disclosure.

INDUSTRIAL APPLICABILITY

In the present disclosure, since foam cement composite boards are industrially produced and can be able to resist fire for four hours or more and insulate sound of 42 decibels or higher and the composition materials are inorganic and inflammable materials and have the comprehensive performances such as energy saving, environmental protection, weight bearing, heat preservation, heat insulation, fire resistance, durability, earthquake resistance, light weight, high strength, the container-type combined house features weight bearing, heat preservation, heat insulation, durability, earthquake resistance, light weight, excellent fireproofing and sound-insulating performances; with good acid-resistance, alkali-resistance and so on, the house is applicable to different environments of high humidity and high corrosiveness. Further, the house has the advantages of waterproofing, sealing and so on. It is simple and easy to mount, operate and maintain the container-type combined house firmly and quickly. According to the present disclosure, the container-type combined houses may be combined into different forms in an overlapping manner or staggered manner. In the present disclosure, the container-type combined house features low carbon, environmental protection, short construction period, simple transportation, no need for assembly and disassembly, recycling use and high safety level and good reliability, it can be used for modular construction in building designing. In conclusion, an energy-saving, environment-friendly and green building product is provided in the present disclosure.

The container-type combined house disclosed herein is mainly used for constructing a house or building of less than three floors. The present disclosure may be widely used for an emergency rescue in a disaster area or used to build a military camp, lodging house or office and other prefabricated buildings. The present disclosure may be applicable in different geographical environments such as hillside, hill, prairie, desert, riverside, plateau and so on.

The invention claimed is:

1. A container combined house, comprising:

a foam cement composite bottom board, foam cement composite wall boards, a foam cement composite top board or a foam cement composite floor board, a specially-shaped bottom beam, a specially-shaped top beam, and a specially-shaped column, wherein the foam cement composite bottom board, the foam cement composite wall boards, the foam cement composite top board or foam cement composite floor board, the specially-shaped bottom beam, the specially-shaped top beam, and the specially-shaped column are fixedly connected to each other in a mechanical or welding manner, the specially-shaped bottom beam is matched in shape with a steel boundary rib of the foam cement composite bottom board and a steel boundary rib of one of the foam cement composite wall boards, the specially-shaped top beam is matched in shape with (i) the steel boundary rib of the one foam cement composite wall board and (ii) a steel boundary rib of the foam cement composite top board or a steel boundary rib of the foam cement composite floor board, the specially-shaped column is matched in shape with the steel boundary rib of the one foam cement composite wall board and a steel boundary rib of a further foam cement composite wall board of the foam cement composite wall boards, the foam cement composite bottom board and the foam cement composite floor board are arranged on a steel base, each of the foam cement composite bottom board and the foam cement composite floor board has four corners provided with four cutouts, respectively for fixing steel columns, a bottom of the foam cement composite wall boards is fixed to the steel base, a connecting part fixedly connects the foam cement composite wall boards and the foam cement composite top board adjacent to the foam cement composite wall boards, the foam cement composite top board is provided with four through holes, the steel columns are arranged at four corners of the steel base by extending through the through holes in the foam cement composite top board, and a seal cap is provided at the steel columns that extend through corresponding four corners of the foam cement composite top board so as to achieve waterproofing effect.

2. The container combined house according to claim 1, wherein the steel base, the connecting part and the steel column are matched in shape with the a floor board steel boundary rib or a wall board steel boundary rib and a top board steel boundary rib and accurately and rapidly connected and fixed in a mechanical or welding manner.

3. The container combined house according to claim 1, wherein the four cutouts located at the four corners of the foam cement composite bottom board each are in a form of square.

4. The container combined house according to claim 1, wherein four cutouts located at the four corners of the foam cement composite floor board each are in a form of square.

5. The container combined house according to claim 1, wherein four corners of the foam cement composite top board are respectively provided with a square through hole.

6. The container combined house according to claim 1, wherein a seal cap is fixedly connected with the foam cement composite top board as a hole seal for a hole of the foam cement composite top board in a mechanical manner.

7. The container combined house according to claim 1, wherein a seal board is arranged between two floors of container houses and fixed on the top board steel boundary ribs in the foam cement composite wall boards of an upper floor and a lower floor and treated with waterproofing process to achieve a waterproofing effect.

8. The container combined house according to claim 1, wherein a steel stairway is provided inside or outside the whole container house to meet a need for use of upper and lower floors.

9. The container combined house according to claim 1, wherein the foam cement composite bottom board is composited with a steel frame, a reinforcement truss, a steel wire mesh, an inorganic foam cement core material, and upper and lower cement mortar surface layers, and the steel wire mesh is fixedly connected to the steel frame.

10. The container combined house according to claim 9, wherein the foam cement composite bottom board includes water drainage pipe fittings having a drain pipe and a floor drain.

11. The container combined house according to claim 10, wherein the foam cement composite wall board is composited with a steel frame, a steel wire mesh, a reinforcement truss, an inorganic foam cement core material, and upper and lower cement mortar surface layers, and the steel wire mesh is fixedly connected to the steel frame.

12. The container combined house according to claim 11, wherein at least one of the foam cement composite wall boards includes a water supply pipe, a water supply connector, a concealed switch box, and a wire pipe, and at least one of the foam cement composite wall boards further includes a door hole and a window hole.

13. The container combined house according to claim 12, wherein the foam cement composite top board is composited with a steel frame, a steel wire mesh, a reinforcement truss, an inorganic foam cement core material, and upper and lower cement mortar surface layers, and the steel wire mesh is fixedly connected to the steel frame.

14. The container combined house according to claim 13, wherein the foam cement composite top board includes a concealed light holder box, a pipeline, a ventilation hole, and a hole for inspection and repair.

15. The container combined house according to claim 14, wherein the foam cement composite board includes a reinforcing rib structure according to the number of the floors to be built and different requirements for strength so as to improve an overall force-bearing strength.

16. The container combined house according to claim 15, wherein according to different temperatures in different geographic regions, a thickness of each of the foam cement bottom board, foam cement composite wall boards, the foam cement composite top board or the foam cement composite floor board is configured to be changed or a polyurethane material with a smaller heat conductivity coefficient is included in the foam cement board.

17. A method of constructing the container combined house of claim 1, comprising the following steps:

(a) performing industrialized custom production of the foam cement composite bottom board, foam cement composite wall boards, and the foam cement composite top board or foam cement composite floor board according to an actual requirement of a customer, and prefabricating water supply pipe fittings, water drainage pipe fittings, electric devices, and a door hole and a window hole in foam cement composite boards according to a design requirement;

(b) fixedly connecting the specially-shaped bottom beam to the steel boundary rib of the foam cement composite bottom board and the steel boundary rib of one of the foam cement composite wall boards in said mechanical manner or welding manner;

(c) fixedly connecting the specially-shaped column with the steel boundary rib of the one foam cement composite wall board and the steel boundary rib of the further foam cement composite wall board of the foam cement composite wall boards in said mechanical manner or welding manner; and (d) fixedly connecting the specially-shaped top beam to the steel boundary rib of the one foam cement composite wall board and the steel boundary rib of the foam cement composite top board or the steel boundary rib of the foam cement composite floor board in said mechanical manner or welding manner.

18. The method according to claim 17, wherein waterproofing and internal and external decorations for the container combined house are completed in a factory as needed.

19. The method of according to claim 17, wherein the foam cement composite board includes a reinforcing rib structure according to a number of floors to be built or different requirements for strength so as to improve an overall force-bearing strength.

20. The method of according to claim 17, wherein according to different temperatures in different regions, a thickness of the foam cement board is changed or a polyurethane material with a smaller heat conductivity coefficient is included in the foam cement board.

* * * * *